US009387363B1

(12) United States Patent
Polinsky

(10) Patent No.: US 9,387,363 B1
(45) Date of Patent: Jul. 12, 2016

(54) BALL AND BOARD BALANCE TRAINING DEVICE

(71) Applicant: Modern Movement, Inc., Waunakee, WI (US)

(72) Inventor: Glenn Polinsky, Waunakee, WI (US)

(73) Assignee: NAUTILUS, INC., Vancouver, WA (US)

( * ) Notice: Subject to any disclaimer, the term of this patent is extended or adjusted under 35 U.S.C. 154(b) by 61 days.

(21) Appl. No.: 13/951,580

(22) Filed: Jul. 26, 2013

Related U.S. Application Data

(60) Provisional application No. 61/676,997, filed on Jul. 29, 2012.

(51) Int. Cl.
*A63B 26/00* (2006.01)

(52) U.S. Cl.
CPC ..... *A63B 26/003* (2013.01)

(58) Field of Classification Search
CPC ..... A63B 22/14; A63B 22/16; A63B 22/18; A63B 22/20; A63B 22/201; A63B 22/203; A63B 22/208; A63B 26/003; A63B 2026/006; A63B 69/0093
USPC ..... 482/139–142, 148
See application file for complete search history.

(56) References Cited

U.S. PATENT DOCUMENTS

| | | | | |
|---|---|---|---|---|
| 478,166 | A | 7/1892 | Madsen | |
| 1,565,484 | A | 12/1925 | McWhirter | |
| 1,585,748 | A | 5/1926 | Wendelken | |
| 1,712,703 | A | 5/1929 | Hudson | |
| 2,714,007 | A | 6/1955 | Jordan | |
| 2,829,892 | A | 11/1955 | Ludwig | |
| 2,764,411 | A | 9/1956 | Washburn, Jr. | |
| 2,803,461 | A | 8/1957 | Coplin | |
| 2,829,891 | A | 4/1958 | Ludwig | |
| 2,906,532 | A * | 9/1959 | Echols | 482/131 |
| 3,024,021 | A * | 3/1962 | Coplin et al. | 482/146 |
| 3,306,626 | A * | 2/1967 | Kawada | 280/205 |
| 3,604,726 | A * | 9/1971 | Tracy | 280/205 |
| 3,612,519 | A | 10/1971 | Larson | |
| 3,862,768 | A * | 1/1975 | England | 280/205 |
| 3,895,794 | A * | 7/1975 | England | 482/146 |
| 4,191,371 | A * | 3/1980 | Armer, Jr. | 482/146 |
| 4,505,477 | A | 3/1985 | Wilkinson | |
| 4,601,469 | A | 7/1986 | Sasser, Jr. | |
| 4,787,630 | A | 11/1988 | Watson et al. | |
| 4,817,950 | A * | 4/1989 | Goo | 463/36 |
| 4,826,159 | A | 5/1989 | Hersey | |
| 4,911,440 | A | 3/1990 | Hyman et al. | |

(Continued)

*Primary Examiner* — Oren Ginsberg
*Assistant Examiner* — Gary D Urbiel Goldner
(74) *Attorney, Agent, or Firm* — Dorsey & Whitney LLP

(57) ABSTRACT

An exemplary exercise device includes a deck, a track, and a ball. Opposing ends of the deck include foot supports. The track bulges upwardly from the deck to form a dome that receives the ball. With the ball and deck on the floor, a user balances herself on the foot supports and may move along multiple axes as the ball rolls on the floor. The user may (for example) pivot and rock the exercise device (as she balances herself), rolling the ball along the track while alternately touching the ends of the deck to the floor, or the user may twist the exercise device clockwise and/or counterclockwise. The exercise device allows for enhanced strength and cardiac training, in addition to balance training, as the user engages in motions and repetitions that may include rolling the ball in the track and contacting different portions of the deck with the floor.

22 Claims, 4 Drawing Sheets

(56) References Cited

U.S. PATENT DOCUMENTS

| | | | | |
|---|---|---|---|---|
| 5,582,567 | A * | 12/1996 | Chang | 482/146 |
| 6,019,712 | A * | 2/2000 | Duncan | 482/110 |
| 6,146,343 | A * | 11/2000 | Stewart | 601/118 |
| 6,436,019 | B1 | 8/2002 | Hollowell | |
| 6,461,285 | B1 | 10/2002 | Theunissen et al. | |
| 6,551,225 | B1 | 4/2003 | Romero | |
| 6,676,150 | B1 | 1/2004 | Goldstein | |
| 6,676,579 | B1 | 1/2004 | Lin | |
| 6,705,977 | B1 | 3/2004 | Ziak | |
| 6,719,676 | B1 | 4/2004 | Hsu | |
| 6,872,175 | B2 * | 3/2005 | Lin | 482/146 |
| 6,916,276 | B1 | 7/2005 | Robinson | |
| 6,945,920 | B1 | 9/2005 | Kemery et al. | |
| 7,070,415 | B2 | 7/2006 | Hojo et al. | |
| 7,081,075 | B2 | 7/2006 | Sachs | |
| 7,083,178 | B2 | 8/2006 | Potter | |
| 7,086,996 | B2 | 8/2006 | Matjacic et al. | |
| 7,097,597 | B2 | 8/2006 | Tamian | |
| 7,112,168 | B2 | 9/2006 | Dalebout et al. | |
| 7,131,934 | B2 | 11/2006 | Dadbeh | |
| 7,134,990 | B2 | 11/2006 | Wischusen | |
| 7,147,591 | B2 | 12/2006 | McAvoy | |
| 7,264,580 | B2 | 9/2007 | Lu | |
| 7,288,055 | B2 | 10/2007 | Blaum | |
| 7,300,392 | B1 | 11/2007 | Curran | |
| 7,357,767 | B2 | 4/2008 | Tsai | |
| 7,424,927 | B2 | 9/2008 | Hiramatsu | |
| 7,467,681 | B2 | 12/2008 | Hiramatsu | |
| 7,475,442 | B1 | 1/2009 | Dierking et al. | |
| 7,479,097 | B2 | 1/2009 | Rosborough et al. | |
| 7,488,177 | B2 | 2/2009 | Pearson | |
| 7,566,291 | B2 | 7/2009 | Lickle | |
| 7,608,017 | B2 | 10/2009 | Nakanishi | |
| 7,670,265 | B1 | 3/2010 | Forrest et al. | |
| 7,686,396 | B2 | 3/2010 | Schaaf | |
| 7,775,939 | B2 | 8/2010 | Nakanishi | |
| 7,775,952 | B1 | 8/2010 | Curran et al. | |
| 7,782,358 | B2 | 8/2010 | Nieminen et al. | |
| 7,881,217 | B2 | 2/2011 | El-Damhougy et al. | |
| 7,887,425 | B2 | 2/2011 | Nakanishi | |
| 7,918,774 | B2 | 4/2011 | Dye | |
| 7,942,797 | B1 | 5/2011 | Canton et al. | |
| 8,033,968 | B2 | 10/2011 | Chen et al. | |
| 8,062,199 | B2 | 11/2011 | Smith | |
| 8,075,449 | B2 | 12/2011 | Lee | |
| 8,105,250 | B2 * | 1/2012 | Wu | 601/49 |
| 8,206,275 | B2 | 6/2012 | Chang | |
| 8,269,826 | B2 | 9/2012 | Nieminen et al. | |
| 8,300,195 | B2 | 10/2012 | Hwang et al. | |
| 8,360,943 | B2 | 1/2013 | Smith | |
| 8,435,164 | B2 | 5/2013 | VanBuren | |
| 8,888,669 | B2 * | 11/2014 | Dunegan | 482/146 |
| 9,084,909 | B1 | 7/2015 | Henley | |
| 2003/0045410 | A1 | 3/2003 | Kao | |
| 2003/0045411 | A1 | 3/2003 | Lin | |
| 2004/0014571 | A1 | 1/2004 | Haynes | |
| 2004/0087421 | A1 | 5/2004 | Lin | |
| 2004/0198573 | A1 | 10/2004 | Brydson et al. | |
| 2005/0170939 | A1 | 8/2005 | Lin | |
| 2006/0073938 | A1 * | 4/2006 | German et al. | 482/51 |
| 2006/0082089 | A1 * | 4/2006 | Rejtano | 280/87.042 |
| 2006/0217242 | A1 * | 9/2006 | Karpachev | 482/77 |
| 2006/0229159 | A1 | 10/2006 | Nagata et al. | |
| 2006/0270536 | A1 | 11/2006 | Tukada | |
| 2007/0027009 | A1 * | 2/2007 | Arnold | 482/146 |
| 2007/0207900 | A1 | 9/2007 | Huang et al. | |
| 2007/0254789 | A1 | 11/2007 | Odien | |
| 2007/0270296 | A1 | 11/2007 | Caldicott | |
| 2007/0298947 | A1 | 12/2007 | Eksteen | |
| 2008/0020856 | A1 | 1/2008 | Rosa | |
| 2008/0020900 | A1 | 1/2008 | Wang | |
| 2008/0039304 | A1 | 2/2008 | Mattox | |
| 2008/0064578 | A1 | 3/2008 | Huang | |
| 2008/0176715 | A1 | 7/2008 | Dick | |
| 2008/0228110 | A1 | 9/2008 | Berme | |
| 2008/0234117 | A1 | 9/2008 | Clark et al. | |
| 2008/0242515 | A1 | 10/2008 | Odien | |
| 2008/0287263 | A1 | 11/2008 | Cheng | |
| 2008/0312043 | A1 | 12/2008 | Cook | |
| 2009/0011393 | A1 | 1/2009 | Lin | |
| 2009/0176635 | A1 | 7/2009 | Brinson | |
| 2009/0186746 | A1 | 7/2009 | Pandolfo | |
| 2009/0192416 | A1 | 7/2009 | Ernst et al. | |
| 2009/0303179 | A1 | 12/2009 | Overholt et al. | |
| 2009/0318274 | A1 | 12/2009 | Welsh | |
| 2010/0197465 | A1 | 8/2010 | Stevenson | |
| 2010/0210978 | A1 | 8/2010 | Oddsson | |
| 2011/0039669 | A1 | 2/2011 | Stewart et al. | |
| 2011/0105286 | A1 | 5/2011 | Dye | |
| 2011/0111934 | A1 * | 5/2011 | Taylor et al. | 482/139 |
| 2011/0143896 | A1 | 6/2011 | Senegal | |
| 2011/0160024 | A1 * | 6/2011 | Candela et al. | 482/132 |
| 2011/0212810 | A1 | 9/2011 | Jeka et al. | |
| 2011/0218077 | A1 | 9/2011 | Fernandez et al. | |
| 2011/0263398 | A1 | 10/2011 | Klassen | |
| 2011/0281702 | A1 * | 11/2011 | Tudico | 482/146 |
| 2012/0018969 | A1 | 1/2012 | Cho | |
| 2012/0065040 | A1 * | 3/2012 | Smith | 482/146 |
| 2012/0115691 | A1 * | 5/2012 | Munroe | 482/110 |
| 2012/0208684 | A1 | 8/2012 | Huang et al. | |
| 2012/0238421 | A1 | 9/2012 | Klopman et al. | |
| 2012/0252645 | A1 * | 10/2012 | Agostini | 482/132 |
| 2012/0258841 | A1 | 10/2012 | James | |
| 2012/0264579 | A1 | 10/2012 | Klein et al. | |
| 2012/0289866 | A1 | 11/2012 | Irby et al. | |
| 2012/0309598 | A1 | 12/2012 | Brentham et al. | |
| 2012/0329619 | A1 | 12/2012 | Goldberg | |
| 2013/0053228 | A1 * | 2/2013 | Winegar | 482/146 |
| 2013/0150220 | A1 | 6/2013 | Chen | |

* cited by examiner

BALL AND BOARD BALANCE TRAINING DEVICE

CROSS-REFERENCE TO RELATED APPLICATIONS

This application claims priority under 35 USC §119(e) to U.S. Provisional Patent Application 61/676,997 filed Jul. 29, 2012, the entirety of which is incorporated by reference herein.

FIELD OF THE INVENTION

This document concerns an invention relating generally to balance training devices that are well-suited to improving balance, and thus reducing the chances of falls and injuries, as well as to training for such sporting activities as skateboarding, snowboarding, surfing, and wakeboarding.

BACKGROUND OF THE INVENTION

Various devices exist that attempt to mimic board and ski sports. The most realistic devices are large, expensive simulators that are inaccessible to most enthusiasts. Other smaller devices exist, but they do not succeed in mimicking the feel of a board and do not provide sufficient exercise and training. Two products in this market category are the Bongo Board™ and the Indo Balance Board™. The Bongo Board has a skateboard deck and a tapered central wheel on which one can balance while shifting one's weight side-to-side. The Indo Balance Board is similar to the Bongo Board but this device uses a long cylinder under a deck to roll the deck across. What is needed is a versatile exercise device that allows for balance, strength, and cardiac training through a fuller range of motion.

SUMMARY OF THE INVENTION

The invention, which is defined by the claims set forth at the end of this document, is directed to balance, strength, and cardiac training devices that at least partially alleviate the aforementioned problems. A basic understanding of some of the features of preferred versions of the invention can be attained from a review of the following brief summary of the invention, with more details being provided elsewhere in this document. To assist in the reader's understanding, the following review makes reference to the accompanying drawings (which are briefly reviewed in the "Brief Description of the Drawings" section following this Summary section of this document).

Referring initially to FIGS. 1A and 1B, an exemplary balance training exercise device 10 includes a deck 100, a ball track 400, and a ball 600. Opposing ends of the deck 100 include a deck first end 110 and a deck second end 120 with a deck first foot support 130 and a deck second foot support 140, respectively. The track 400 bulges upwardly from the deck 100 to form a track valley 410 that is sized to receive the ball 600 therein. With the ball 600 on a floor 30, the deck 100 can be placed over the ball 600, and a user 700 may stand on the deck 100, with two feet 710, 720 on the deck first and second foot supports 130, 140. A stand 800 may be used to help the user 700 climb onto the exercise device 10 without falling over (see FIGS. 4A, 4B). Once the user 700 is standing on the deck 100, the user 700 may move along multiple axes as the ball 600 rolls on the floor 30. For example, the user 700 may pivot or rock the exercise device 10 with the ball 600 as fulcrum (as he or she balances himself or herself), alternately touching the deck first end 110 and the deck second end 120 to the floor 30 (see FIGS. 2A-2D), or the user 700 may twist the exercise device 10 clockwise and/or counterclockwise (see FIGS. 3A-3C). The exercise device 10 allows for enhanced strength and cardiac training, in addition to balance training, as the user 700 engages in motions and repetitions that may include rolling the ball 600 along the length of the track 400 and contacting different portions of the deck 100 with the floor 30.

The spherical shape of the ball 600 (which may be a medicine ball) makes it possible for the deck 100 to tip in any direction, unlike other devices that provide instability or movement only laterally. This involves (for example) balance in both the X- and Y-axes. Exercises performed on the exercise device 10 may emphasize movement, not just balance, providing increased cardiac and muscle workouts compared to other devices. Advantageous features of the exercise device 10 include: (1) providing a full range of instability in balance; (2) providing the options of side-to-side and twisting movements; (3) proximity of the deck 100 to the ground (that is, the deck 100 is low to the ground), allowing for faster-paced repetitions that involve alternate contacts of the deck 100 with the floor 30, enhancing cardiac workouts; (4) full body movement, not simply finding one's center of gravity; (5) movements in cycles of push-off, instability, and landing; (6) appropriate cardiac impact in addition to balance training; and (7) muscle strength training in addition to balance training. The exercise device can be beneficial not just to improve balance in athletes, but for all users because improved balance can help reduce the risks of falls and the injuries resulting therefrom.

Further advantages and features of the invention will be apparent from the remainder of this document in conjunction with the associated drawings.

BRIEF DESCRIPTION OF THE DRAWINGS

FIGS. 3A-3C show the exercise device 10 of FIGS. 1A and 1B being twisted in a clockwise fashion as part of an exemplary exercise.

DETAILED DESCRIPTION OF PREFERRED VERSIONS OF THE INVENTION

Figure 1A:
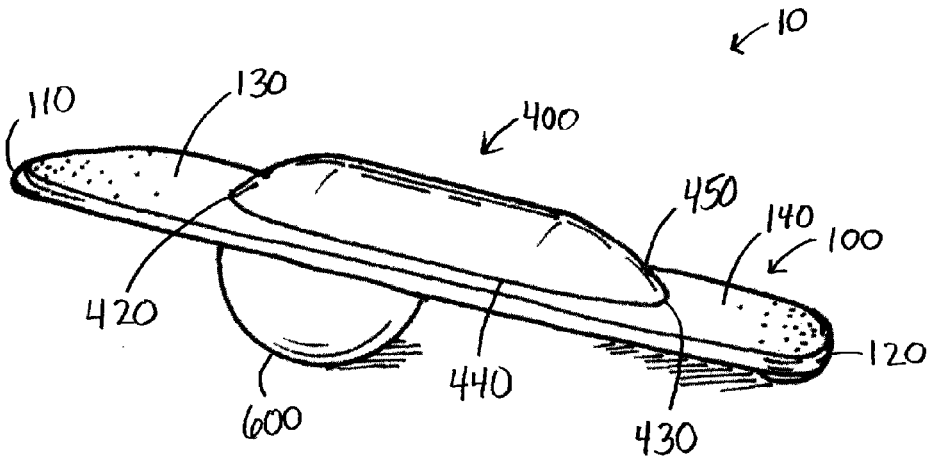
FIG. 1A is a perspective view of an exemplary exercise device 10 having a deck 100 with deck first and second foot supports 130, 140 at opposing ends thereof, a track 400 extending upwardly from the deck 100, and a ball 600 receivable in a track valley 410 formed by the concavity of the track 400.
Figure 1B:
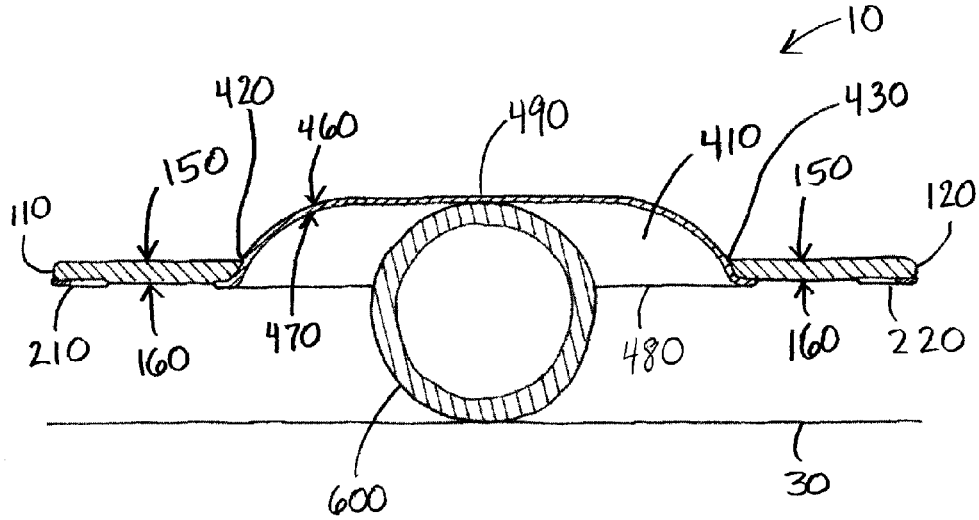
FIG. 1B is a longitudinally-bisecting cross-section of the exercise device 10 of FIG. 1A.

Turning initially to FIGS. 1A and 1B, an exemplary exercise device 10 which illustrates preferred features of the invention is designated generally by the reference numeral 10. The deck 100 of the exercise device 10 includes a deck upper surface 150 and an opposing deck lower surface 160, a deck length extending longitudinally from the deck first end 110 to the deck second end 120, and a deck width extending laterally from the deck first side 170 to a deck second side 180. As shown in the figures, the deck 100 is elongated, with the deck length being greater than the deck width. The first foot support 130 and the second foot support 140 longitudinally extend from opposing ends 420, 430 of the domed track 400. The foot supports may have substantially the same dimensions for symmetry. A first sidebar 190 and a second sidebar 200 laterally extend from opposing sides 440, 450 of the domed track 400. The deck 100 is substantially defined by the first and second foot supports 130, 140 and the first and second sidebars 190, 200 that surround the domed track 400. The deck first foot support 130 and the deck second foot support 140 may have nonskid surfaces to limit the risk that a user 700 will unintentionally slip off the exercise device 10 while exercising. A deck first bumper 210 may be included on the deck lower surface 160 at the deck first end 110, and a deck second bumper 220 may be included on the deck lower surface 160 at the deck second end 120. The first and second bumpers 210, 220 may, for example, provide friction (to decrease slippage) and be used to adjust the relative distance between the ends 110, 120 of the exercise device 10 and the floor 30.

The domed track 400 (or half-tablet) includes a convex side 460 opposing a concave side 470 that forms the track valley 410 that receives at least a portion of the ball 600 therein. The track 400 includes a track width extending laterally from a track first side 440 to a track second side 450, and a track length extending longitudinally from a track first end 420 to a track second end 430. As shown in the figures, the track 400 is elongated, with the track length being greater than the track width. The track 400 also includes a track height extending from a track nadir 480 to a track apex 490, the track height being between approximately a quarter and approximately a half of the resting radius of the ball 600 (that is, the radius of a cross-section of the spherical ball 600 when the ball 600 is not being compressed by, for example, the weight of the user 700). The track 400 is at least substantially centered between the deck first end 110 and the deck second end 120 for symmetry, and may further be substantially centered between the deck first side 170 and the deck second side 180. The ball track 400 in the figures extends upwardly from the deck 100, placing the user's feet 710, 720 closer to the floor 30 for a lower step-on height and facilitating easy touch down at the end of an exercise cycle.

The hardness of the ball 600 may be varied to adjust the parameters of a workout. For example, if the ball 600 is inflatable, relatively higher pressure (such as 10 psi) may be well-suited to quicker movements for increased cardio impact, and relatively lower pressure (such as 5 psi) may provide more resistance and enhanced strength training. If the ball 600 is solid, the exercise device 10 could include two or more interchangeable balls 600 of differing hardness to replicate the effects of inflating or deflating a ball 600. The walls of ball 600 may be thick enough that its structure allows the ball 600 to hold its shape, but the ball 600 may nonetheless include a valve that allows for changes in pressure and/or hardness. For example, a relatively lighter 3 kg ball may be made harder by adding some pressure (for example, 5 psi). It is noted that a standard medicine ball may begin to deform at about 10 psi or higher.

To use the exercise device 10, a user 700 may place the ball 600 on the floor 30, and position the exercise device 10 over the ball 600 with the concave side 470 of the track 400 facing down. The user 700 may then stand with a first foot 710 and a second foot 720 on the first and second foot supports 130, 140, respectively. The ball 600 fits into the domed track 400 and rolls against the concave side 470 of the track 400 as the user 700 balances to keep the first foot 710 and the second foot 720 from touching the floor 30. The deck 100 can move three-dimensionally as the ball 600 rolls on the floor 30.

Figure 2A:
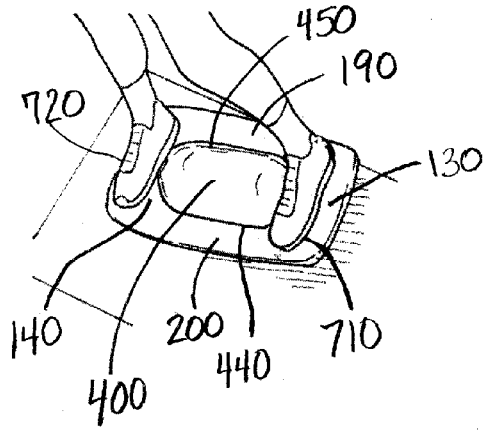
FIG. 2A shows the exercise device 10 of FIG. 1A with a user 700 standing thereon and the deck first foot support 130 making contact with the floor 30.
Figure 2B:
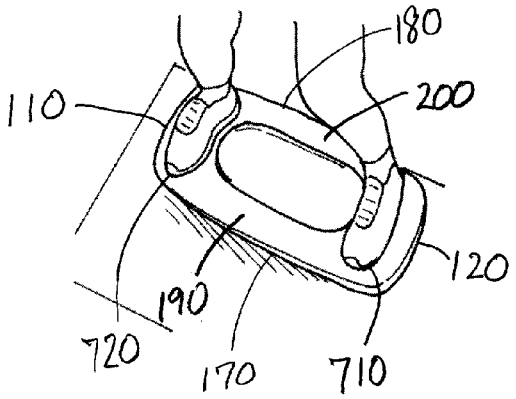
FIG. 2B shows the exercise device 10 of FIG. 2A with the user 700 shifting the exercise device 10 so as to raise the deck first foot support 130 off the floor 30.
Figure 2C:
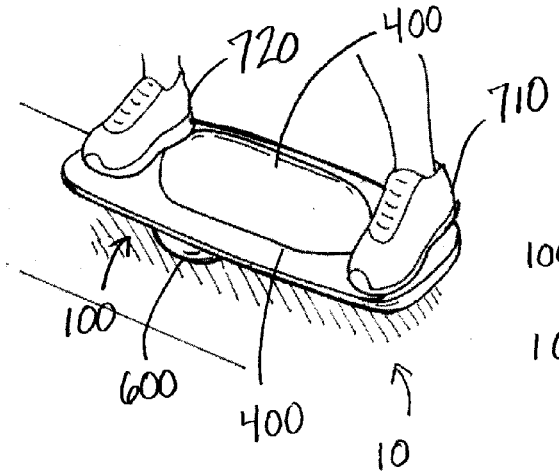
FIG. 2C shows the exercise device 10 of FIG. 2B with the deck 100 approximately level with the floor 30.
Figure 2D:
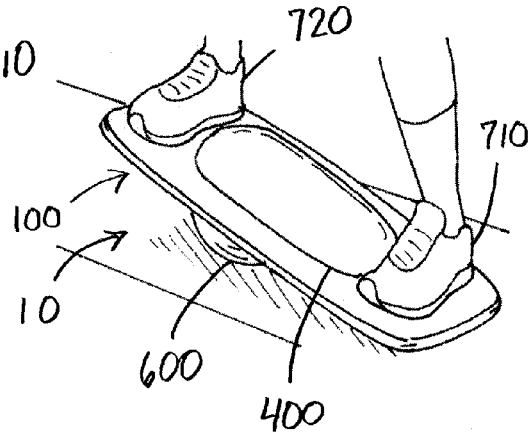
FIG. 2D shows the exercise device 10 of FIG. 2C with the deck second foot support 140 contacting the floor 30.

In one side-to-side exercise that can be performed with the exercise device 10 (see, e.g., FIGS. 2A-2D), the deck 100 is positioned over the ball 600 with the ball 600 in the ball track 400 at an end of the ball track 400. The user 700 places his or her feet 710, 720 on the foot supports 130, 140. The exercise device 10 may be pivoted (with the ball 600 as a sort of fulcrum) such that the deck first and second ends 110, 120 alternately contact the floor 30 as the user 700 balances the exercise device 10 on the ball 600. The first and second deck bumpers 210, 220 may alternately contact the floor 30 as the user 700 longitudinally pivots the exercise device 10. Between the shifts, when both foot supports 130, 140 are off the floor 30 (see FIG. 2C), the deck 100 may travel sideways relative to the user 700 as the ball 600 rolls along the length of the track 400. As a result, in addition to the balancing and strength workouts achieved from the user 700 shifting weight between foot supports 130, 140 and pushing against alternate ends 110, 120 of the deck 100, the user 700 may achieve an enhanced cardiac workout by rhythmically rolling the ball 600 on the floor 30 approximately the track length as opposing ends 110, 120 of the deck 100 are being touched to the floor 30. To successfully perform the exercise, the user 700 should maintain balance while the deck 100 moves left to right and vice versa. This exercise can provide muscle strengthening in the legs and torso, and is particularly useful for such sports as skateboarding, skiing, and surfing.

Figure 3A:
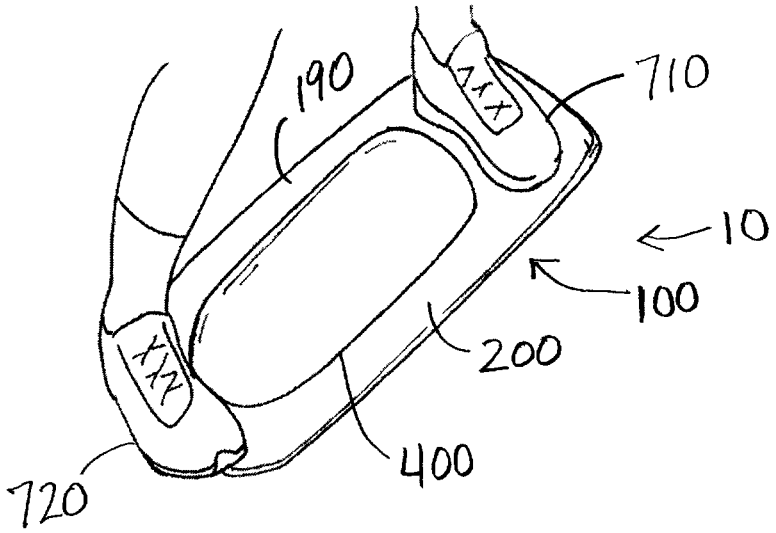
Figure 3B:
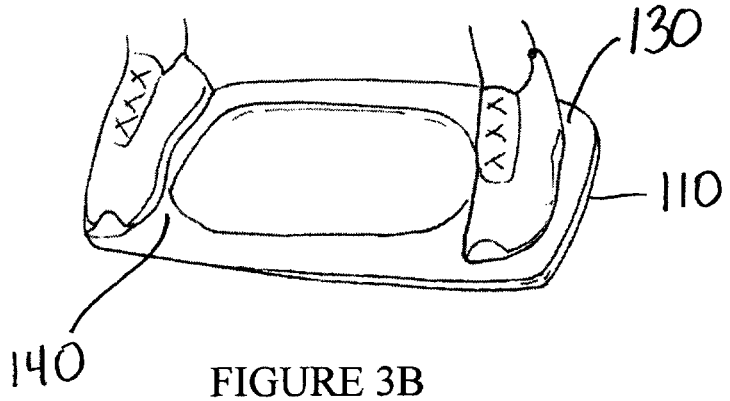

In another exercise (see, e.g., FIGS. 3A-3C), the user 700 may twist the exercise device 10 in alternating clockwise and counterclockwise directions without the feet 710, 720 of the user 700 contacting the floor 30. Initially, one end of the deck 100 may be on the floor 30 with the user's feet 710, 720 on the foot supports 130, 140. The user 700 shifts weight towards the elevated foot and simultaneously twists. This brings the lowered end of the deck 100 off the floor 30, requiring the user 700 to balance over the ball 600 while turning or spinning. The deck 100 comes to rest again with the initially lowered end again in contact with the floor 30. The exercise can then be repeated (e.g., back and forth in opposite directions of spin). This exercise requires balance and provides cardiac training and strengthening of leg and core muscles.

Figure 4A:
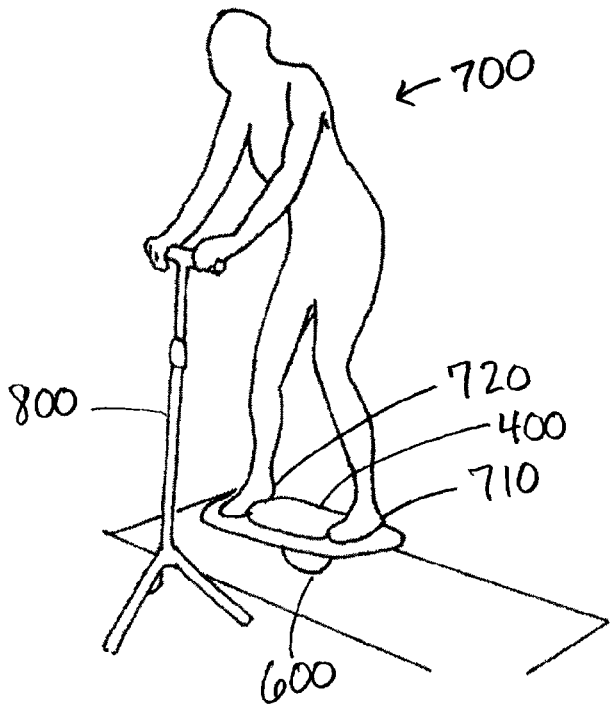
FIG. 4A shows a user 700 standing on the exercise device 10 of FIGS. 1A, 1B, 2A-2D, and 3A-3C, with an exemplary stand 800 being used for assistance in balancing on the exercise device 10.
Figure 4B:
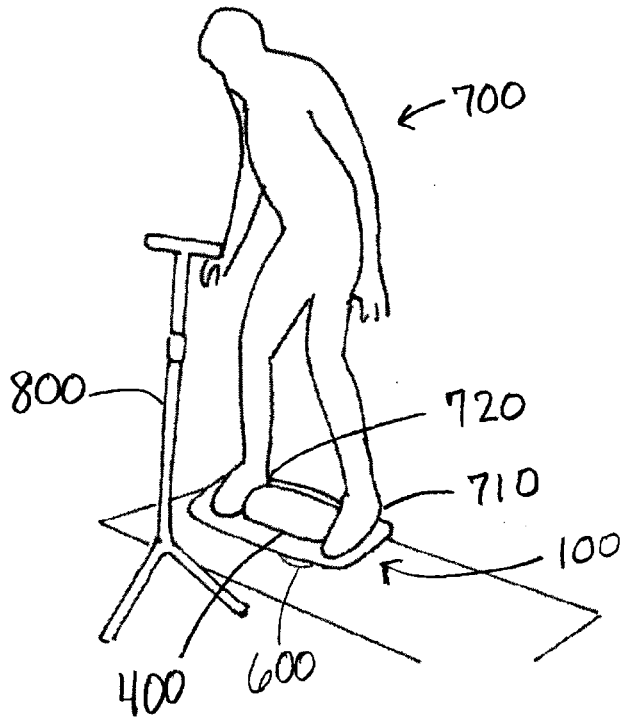
FIG. 4B shows the user 700 of FIG. 4A performing an exemplary static exercise without assistance from the stand 800.

FIGS. 4A and 4B illustrate an exemplary use of the exercise device 10 for static balance training. The user 700 may mount the exercise device 10 using a support stand 800 or similar aid if desired. The user 700 then releases any support and attempts to stay balanced over the ball 600. This exercise helps to improve balance and also strengthens leg muscles straining to maintain balance.

Preferred versions of the invention have been reviewed in the foregoing discussion to illustrate different possible features of the invention and the varying ways in which these features may be combined. Apart from combining the different features of the foregoing versions in varying ways, other modifications are also considered to be within the scope of the invention. Following is an exemplary list of such modifications.

Initially, it must be kept in mind that the exercise device 10 shown in the accompanying drawings and discussed above are merely exemplary, and may assume a wide variety of configurations different from those noted, and may use components different from those noted.

It should also be understood that various terms referring to orientation and position are used throughout this document—for example, "lower" (as in "deck lower surface")—are relative terms rather than absolute ones. Thus, such terms should be regarded as words of convenience, rather than limiting terms. In other words, it should be understood (for example) that relative positions of components may vary depending on the overall orientation of the device and on the application in which they are used.

Also in the following description, it is to be understood that such terms as "forward," "rearward," "left," "right," "upwardly," "downwardly," and the like are words of convenience and are not to be construed as limiting terms.

Various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

First, although the first and second foot supports 130, 140 in the figures are shown to be substantially coplanar, the foot supports may instead have any other suitable three-dimensional shape. For example, the foot supports may curve upwards to restrict the foot from longitudinally slipping off the exercise device 10, or have valleys for receiving a user's feet.

Second, although the track 400 and deck 100 are shown in the figures to be elongated, with the first and second foot supports 130, 140 having greater surface area than the first and second sidebars 190, 200 of the deck 100, the deck 100 and track 400 may have other configurations as well. For example, the track 400 may have a more circular cross-section to allow for exercises that involve rolling the ball 600 such that the exercise device 10 traces circular patterns on the floor 30. The sidebars may also be wide enough to allow users 700 to position their feet 710, 720 thereon.

Third, in the version shown in the figures, the deck 100 is balanced and rolled on a ball 600 in a ball track 400. In alternative versions, different means for balancing the deck 100 on a ball 600 may be used. For example, the deck 100 could include a pair of rails that rest on the ball 600 to provide the same multidimensional instability and capacity for side-to-side motion.

Fourth, although the deck 100 is shown as a single continuous surface surrounding the ball track 400, other configurations may be utilized. For example, the deck 100 may comprise two surfaces at opposite ends of the deck underlying all or part of the foot supports 130, 140. Additionally, the shape of the deck 100 and track 400 may vary considerably for practical and/or aesthetic reasons.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A balance training exercise device for use on a support surface, the exercise device comprising:
- a ball operable to engage the support surface;
- a deck including:
  - a deck upper surface and an opposing deck lower surface;
  - a deck length extending longitudinally from a deck first end to a deck second end; and
  - a deck width extending laterally from a deck first side to a deck second side; and
- a track extending upwardly from the deck upper surface to form a track valley sized to receive at least a portion of the ball therein, the track valley including a track height extending from a track nadir to a track apex, the track including:
  - a track length extending longitudinally from a track first end to a track second end; and
  - a track width extending laterally from a track first side to a track second side, the track length being greater than the track width;
- wherein the track height is constant along a majority of the track length between the track first end and the track second end; and
- wherein when the deck is placed over the ball with the ball received in the track valley, the exercise device is operable to:
  - move as the ball moves on the support surface; and
  - pivot such that the deck first and second ends can alternately contact the support surface as the user balances the deck on the ball.

2. The exercise device of claim 1, wherein the exercise device will further laterally pivot such that the deck first and second sides alternately approach the support surface.

3. The exercise device of claim 1, wherein:
- the deck first end includes a first foot support, and the deck second end includes a second foot support; and
- the first and second foot supports are at least substantially coplanar.

4. The exercise device of claim 1, wherein:
- the track extends a track height upwardly from the deck upper surface; and
- the track height is no greater than a resting radius of the ball.

5. The exercise device of claim 1, wherein the track is at least substantially centered between:
- the deck first end and the deck second end; and
- the deck first side and the deck second side.

6. The exercise device of claim 1, further including a deck first bumper on a bottom surface of the deck first end, and a deck second bumper on a bottom surface of the deck second end.

7. The exercise device of claim 1, further including a stand for use in climbing onto the exercise device.

8. A method of using the exercise device of claim 1, the method including the steps of:
- placing the ball on a floor;
- placing the deck over the ball;
- placing a first foot on the deck first end; and
- placing a second foot on the deck second end while balancing to keep from falling over.

9. The method of claim 8, further including the step of twisting the exercise device in alternately clockwise and counterclockwise directions without the feet of the user contacting the floor.

10. The method of claim 8, further including the steps of, while continuing to balance on the exercise device:
- touching the deck first end to the floor;
- raising the deck first end from the floor;
- rolling the ball along the track from the track first end to the track second end, the track first end being opposite the track second end; and
- touching the deck second end to the floor.

11. The exercise device of claim 1, wherein the deck and the track are separate pieces secured together.

12. The exercise device of claim 1, wherein:

the ball includes a ball resting radius defining an outer surface shape; and each of the track first end and the track second end defines a curved shape that closely matches the outer surface shape of the ball.

13. The exercise device of claim 1, wherein the track apex extends linearly along the track length between a first portion of the track length adjacent to the track first end and a second portion of the track length adjacent to the track second end.

14. A balance training exercise device for use on a support surface, the exercise device comprising:

a ball operable to engage the support surface; and a symmetrical deck including:

a deck upper surface opposing a deck lower surface;

a deck length and a deck width, the deck length being greater than the deck width; and a deck outer perimeter surrounding a symmetrical track, the track:

extending upwardly from the deck upper surface to form a track valley sized to complimentarily receive at least a portion of the ball therein when the track is placed over the ball, the track valley including a track height extending from a track nadir to a track apex;

being centralized between opposing ends and opposing sides of the deck; and including a track length greater than a track width;

wherein the track height is constant along a majority of the track length; and wherein when the ball is placed on the support surface and the track is placed over the ball, the exercise device is movable in multiple three-dimensional directions as the ball moves on the support surface.

15. The exercise device of claim 14, further including:

a first foot support and a second foot support at opposing ends thereof; and a first bumper and a second bumper underneath the first foot support and the second foot support, respectively.

16. The exercise device of claim 14, wherein when the track is fit over the ball, the track extends over the ball:

no less than at least substantially 0.25 of a resting radius of the ball; and no more than at least substantially 0.5 of the resting radius of the ball.

17. The exercise device of claim 14, wherein:

the ball includes a ball resting radius defining an outer surface shape; and each of the track first end and the track second end defines a curved shape that closely matches the outer surface shape of the ball.

18. A balance training exercise device for use on a support surface, the exercise device comprising:

a ball operable to engage the support surface;

a domed track including a concave side opposing a convex side, the track including:

a track width extending laterally from a track first side to a track second side;

a track length extending longitudinally from a track first end to a track second end, the track length being greater than the track width; and a track height extending from a track nadir to a track apex, the track height being no greater than a resting radius of the ball, the track height being constant along a majority of the track length between the track first end and the track second end;

a first foot support and a second foot support longitudinally extending from opposing ends of the domed track, each foot support including at least substantially the same surface area; and a first sidebar and a second sidebar laterally extending from opposing sides of the domed track;

wherein when the exercise device is positioned with the concave side of the track facing the support surface, the ball is received at least partially in the domed track and rolls against the concave side of the track between the track first end and the track second end.

19. The exercise device of claim 18, wherein:

the first foot support and the second foot support are at least substantially coplanar; and the track extends upwardly from the first and second foot supports.

20. The exercise device of claim 18, wherein the first and second foot supports have greater surface area than the first and second sidebars.

21. The exercise device of claim 18, wherein:

the ball includes a ball resting radius defining an outer surface shape; and each of the track first end and the track second end defines a curved shape that closely matches the outer surface shape of the ball.

22. The exercise device of claim 18, wherein the first and second foot supports and the first and second sidebars are at least partially coplanar.

* * * * *